US005617997A

United States Patent [19]

Kobayashi et al.

[11] Patent Number: 5,617,997

[45] Date of Patent: Apr. 8, 1997

[54] NARROW SPRAY ANGLE LIQUID FUEL ATOMIZERS FOR COMBUSTION

[75] Inventors: William T. Kobayashi, Sao Paulo, Brazil; Arthur W. Francis, Jr., Monroe, N.Y.

[73] Assignee: Praxair Technology, Inc., Danbury, Conn.

[21] Appl. No.: 589,429

[22] Filed: Jan. 22, 1996

Related U.S. Application Data

[63] Continuation of Ser. No. 259,081, Jun. 13, 1994, abandoned.

[51] Int. Cl.[6] ..... B05B 7/06

[52] U.S. Cl. ..... 239/8; 239/424

[58] Field of Search ..... 239/416, 416.5, 239/423, 424, 8; 431/1, 9

[56] References Cited

U.S. PATENT DOCUMENTS

| | | | |
|---|---|---|---|
| 624,130 | 5/1899 | Thurman | 239/416.4 |
| 1,161,183 | 11/1915 | Beach | 239/416.4 X |
| 1,404,429 | 1/1922 | Scheib | 239/416.4 |
| 1,824,806 | 4/1927 | Ryder et al. | 239/416.4 |
| 3,088,854 | 5/1963 | Spies | 239/424.5 X |
| 3,610,537 | 10/1971 | Nakagawa | 239/424.5 X |
| 4,073,871 | 2/1978 | Opitz et al. | 239/422 X |
| 4,523,529 | 6/1985 | Poll | 110/8 |
| 4,541,796 | 9/1985 | Anderson | 431/187 |
| 4,738,614 | 4/1988 | Snyder et al. | 431/8 |
| 4,858,538 | 8/1989 | Kuypers et al. | 110/263 |
| 4,863,371 | 9/1989 | Ho | 431/9 |
| 4,865,542 | 9/1989 | Hasenack et al. | 431/160 |
| 4,907,961 | 3/1990 | Anderson | 431/8 |
| 4,946,382 | 8/1990 | Kobayashi et al. | 431/8 |
| 4,969,814 | 11/1990 | Ho et al. | 431/8 |
| 4,988,285 | 1/1991 | Delano | 431/5 |
| 5,076,779 | 12/1991 | Kobayashi | 431/5 |
| 5,127,346 | 7/1992 | Kepplinger et al. | 110/264 |
| 5,201,650 | 4/1993 | Johnson | 431/9 |
| 5,203,859 | 4/1993 | Khinkis et al. | 432/30 |
| 5,242,296 | 9/1993 | Tuson et al. | 431/10 |
| 5,267,850 | 12/1993 | Kobayashi et al. | 431/8 |

FOREIGN PATENT DOCUMENTS

| | | | |
|---|---|---|---|
| 856575 | 8/1981 | U.S.S.R. | 239/423 |

*Primary Examiner*—Kevin Weldon
*Attorney, Agent, or Firm*—Leisa M. Smith

[57] ABSTRACT

The invention relates to an improvement in atomizing methods and apparatus useful for combusting liquid fuel, such oil. The atomizing methods and apparatus consistently produce liquid fuel streams having vary narrow spray angles. The liquid fuel streams having very narrow spray angles can be produced even when a low liquid fuel flow rate is employed and even when a liquid fuel stream is atomized outside a liquid fuel passageway. The production of the constant narrow spray angle liquid fuel stream allows the atomizing apparatus to operate for a long period without causing fouling problems even if they are sufficiently recessed from internal openings of refractory ports defined in the furnace wall.

17 Claims, 1 Drawing Sheet

NARROW SPRAY ANGLE LIQUID FUEL ATOMIZERS FOR COMBUSTION

This application is a Continuation of prior U.S. application: Ser. No. 08/259,081 Filing Date Jun. 13, 1994 now abandoned.

FIELD OF THE INVENTION

The invention relates to atomizing apparatus and methods for producing a liquid fuel stream having a very narrow spray angle which is useful for effective combustion.

BACKGROUND OF THE INVENTION

High temperature combustion is often employed in many industrial processes, such as glassmelting and waste incineration. The burners used to carry out such processes often utilize liquid fuel, such as oil. U.S. Pat. No. 4,541,796, for example, describes a burner having at least two passageways for delivering liquid fuel and oxidant separately to a point outside of the burner. The liquid fuel delivered separately is initially atomized and is then mixed and combusted with the oxidant. Atomization of liquid fuel is necessary for effective combustion.

U.S. Pat. No. 4,738,614 describes an atomizer useful for, inter alia, those burners described and claimed in U.S. Pat. No. 4,541,796. The atomizer has a specifically designed liquid fuel passageway and an angular atomizing fluid port. While the liquid fuel is injected through the liquid fuel passageway, atomizing fluid is introduced to the fuel passageway at an angle of 45 to 75 degrees, preferably at an angle of 60 degrees, measured from the longitudinal axis of the fuel passageway, through the angular atomizing fluid port. This atomizer is indicated to be superior to known pressure and mechanical atomizers in avoiding problems, such as mechanical break down of moving parts or plugging of very small liquid fuel orifices.

This atomizer, however, suffers from certain drawbacks. First, the control of liquid fuel flow is difficult since the atomizer is designed in such a manner that there is a pressure dependence between the liquid fuel and the atomizing fluid. Increasing the flow of the atomizing fluid, for example, causes an increased back pressure on the liquid fuel supply whereby the flow control of liquid fuel supply is made difficult. Second, this atomizer cannot be operated effectively, when it is recessed within a refractory port of the furnace wall. The atomized fuel stream, such as oil, impinges on the inside surface of the refractory port, causing the formation of soot within the port, thus fouling the atomizer and the port. Finally, this atomizer may cause unsafe combustion if the atomizing fluid employed contains oxygen. Because the liquid fuel is internally atomized within the fuel passageway with a fluid fuel atomizing fluid, the liquid fuel may flow into the atomizing fluid (oxygen) line, thus causing unsafe combustion.

It is therefore an object of the invention to provide an atomizing means useful for effectively controlling the flow of liquid fuel.

It is another object of the invention to provide an atomizing means that can be used effectively in atomizing and combusting liquid fuel without fouling the atomizing means even when it recessed within a refractory port of the furnace wall.

It is yet another object of the invention to provide an atomizing means which can utilize atomizing fluid containing oxygen with the minimal risk of unsafe combustion.

It is an additional object of the invention to provide an atomizing means which can be incorporated into a burner capable of operating without any water cooling means.

SUMMARY OF THE INVENTION

The above objectives and other objectives apparent from reading this disclosure are achieved by the present invention, one aspect of which is:

An apparatus for dispersing fluid fuel for effective combustion with reduced nitrogen oxides generation, said apparatus comprising:

(a) a nozzle having interior and exterior surfaces, with said interior surface defining a liquid passageway and a liquid fuel port, said liquid fuel port having inlet for receiving liquid fuel from said liquid fuel passageway and outlet for discharging liquid fuel; and (b) an enclosure having interior and exterior surfaces concentrically surrounding at least a portion of said nozzle and defining an annular passageway and an annular atomizing fluid port between said interior surface of said enclosure and said exterior surface of said nozzle, with said annular passageway terminating with said annular atomizing fluid port having inlet and outlet openings, wherein both at least a portion of the interior surface of said enclosure and at least a portion of said exterior surface of said nozzle defining said annular atomizing fluid port are in the form of a cone having a diameter decreasing toward said outlet opening of said annular atomizing fluid port, at an angle in the range of about 5° to about 30°, measured from a longitudinal axis of said nozzle, the nozzle, between the interior and exterior surfaces, converges to a sharpened annular edge at the outlet of the fuel port.

Another aspect of the present invention is:

A process for atomizing liquid fuel to provide a liquid fuel stream in the form of a spreading spray having an outer periphery angle of less than 15°, measured from the axis of said liquid fuel stream, thus promoting effective combustion with reduced nitrogen oxide generation, said process comprising:

(a) ejecting a liquid fuel stream from at least one first opening;

(b) ejecting a liquid fuel atomizing fluid at a velocity of about 0.5 Mach to about 1.2 Mach toward said liquid fuel stream at a converging angle of about about 5° to about 30°, measured from the longitudinal axis of said liquid fuel stream from at least one second opening annular to said at least one first opening.

DETAILED DESCRIPTION OF THE INVENTION

Figure 1:
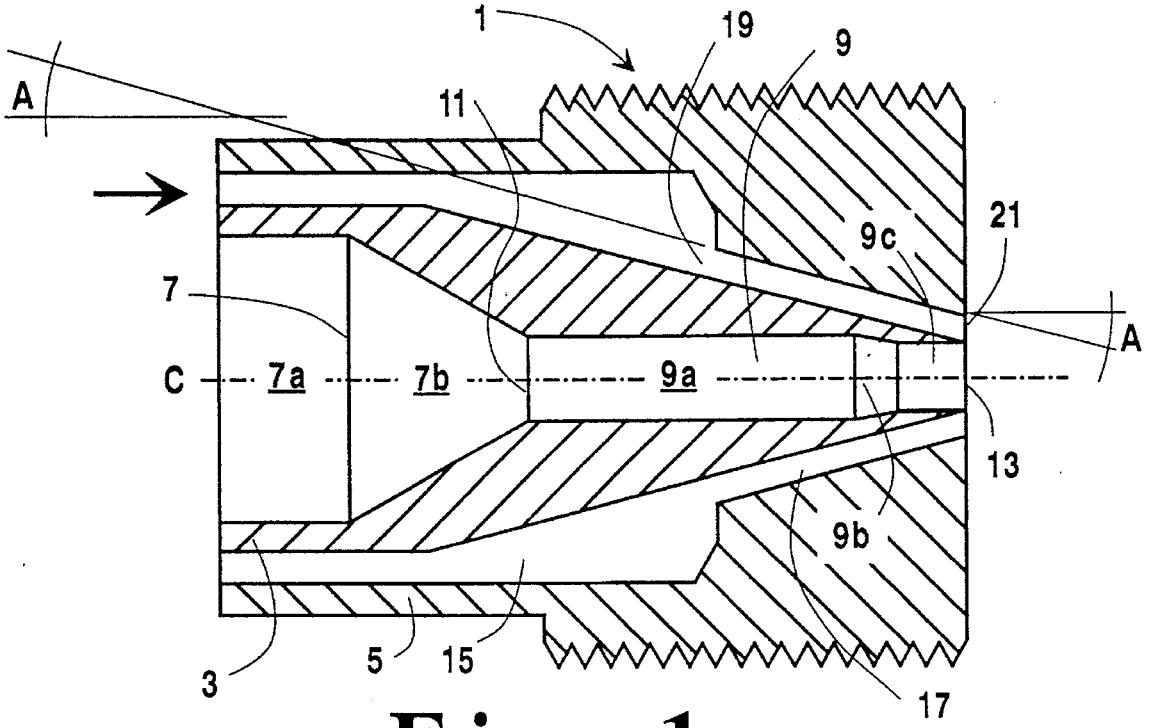
FIG. 1 is a cross-sectional view of a liquid fuel burner atomizer which is one embodiment of the present invention.

The invention relates to an improvement in atomizing methods and apparatus useful for combusting liquid fuel, such oil. The atomizing methods and apparatus consistently produce liquid fuel streams having vary narrow spray angles. The liquid fuel streams having very narrow spray angles can be produced even when low liquid fuel flow rates are employed and even when liquid fuel streams are atomized outside a liquid fuel passageway. The production of the constant narrow spray angle liquid fuel streams allow the atomizing apparatus to operate for a long period without causing fouling problems even if the apparatus is sufficiently recessed from internal openings of refractory ports defined in the furnace wall. The internal openings of the refractory ports face a combustion zone within the furnace whereby the atomized liquid ejected from the atomizing apparatus is allowed to be combusted within the combustion zone. Since the atomizing apparatus can be effectively operated in a recessed manner, no water cooling is needed, thus avoiding potential corrosion related problems. In addition, the atomizing methods and apparatus substantially prevent the liquid fuel from entering into an atomizing fluid passageway of the atomizing apparatus. Since the liquid fuel does not enter the atomizing fluid passageway, an oxygen containing gas can be used as an atomizing fluid, with the minimal risk of unsafe combustion.

The invention will be described in detail with reference to a preferred atomizing apparatus shown in the drawings. However, as can readily be appreciated, the description of the preferred atomizing apparatus in no way precludes other variations of the preferred atomizing apparatus, which will become readily apparent to those skilled in the art.

Figure 2:
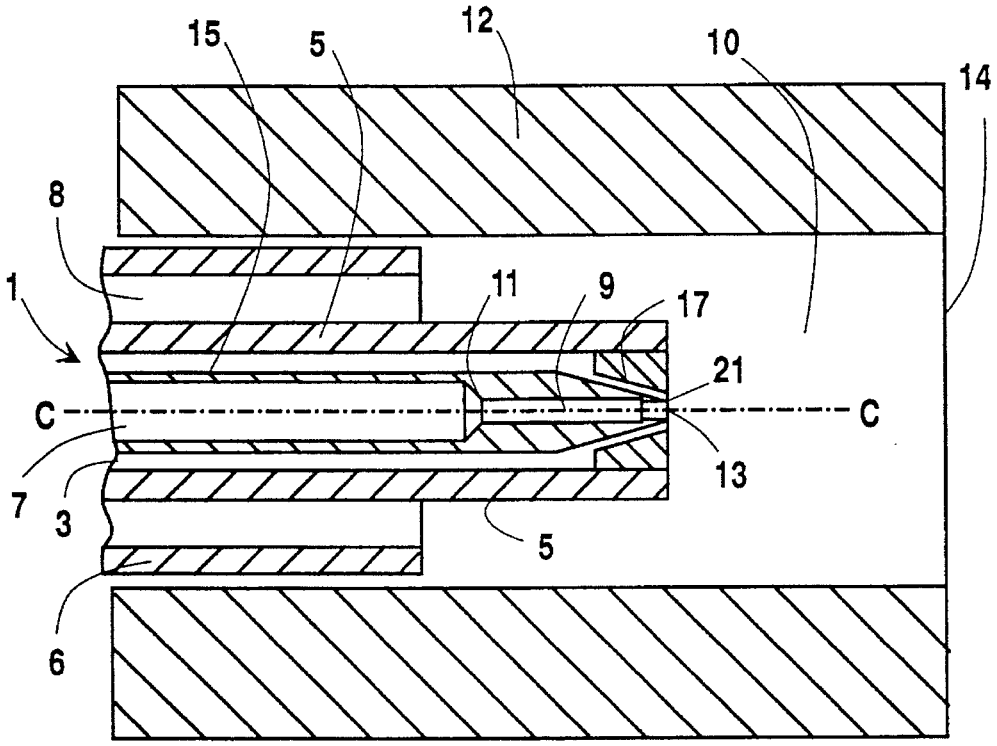
FIG. 2 is a cross-sectional view of a liquid fuel burner having the atomizer of FIG. 1, wherein the burner is recessed within refractory ports of the refractory furnace wall.

Referring now to FIGS. 1 and 2, there is illustrated a cross-sectional view of an atomizing apparatus (1) having a nozzle (3) and an enclosure (5), which are arranged in a concentric fashion. The apparatus (1) can be easily assembled by placing the nozzle (3) coaxially within the enclosure (5). An additional enclosure (6), e.g., an additional fluid conduit, may be provided to concentrically surround the enclosure (5) if an additional annular passageway (8) is needed to eject oxidant for effective combustion or eject additional atomizing fluid for effective atomization. The nozzle (3) and the enclosures may be combined by using any known joining means, including but not limited to a machine thread and a compression type mechanical sealing means, such as welding, brazing, cementing or gluing. The apparatus (1) can be incorporated into any burner including a non-water cooled duel fuel burner which may be recessed from the internal opening (14) of a refractory port (10) of the furnace wall (12). A gas-cooled dual fuel burner, for example, may employ the apparatus (1) to eject atomized liquid fuel and then use its outer annular passageways or other passageways to eject a different fuel, such as a fluid containing coal particles, and oxidant streams. The apparatus (1) may be made with any materials which are compatible to its end usage. Such materials include, among other things, stainless steel, metals, ceramics and plastics.

The nozzle (3) has interior and exterior surfaces, with the interior surface defining a liquid fuel passageway (7) which terminates with a liquid fuel port (9). The liquid fuel passageway (7) may comprise at least two lengths. The first length (**7*a*) has a relatively large cross-sectional area or diameter while the second length (7*b*), which communicates with the first length (7*a*), has a cross-sectional area which decreases in the direction of the liquid fuel port (9) (a radially decreasing taper), preferably in the form of a cone. The liquid fuel port (9) has an inlet (11) for receiving liquid fuel from the liquid fuel passageway (7) and an outlet (13) for discharging liquid fuel. The inlet (11) of the liquid fuel port (9) is normally located at the end of the second length (7*b*) and has a cross-sectional area or diameter equal to or smaller than the cross-sectional area or diameter at the end of the second length (7*b*). The liquid fuel port (9) may comprise at least three sections, with the first section (9*a*) having a cross-sectional area or a diameter equal to or smaller than the cross-sectional area or diameter at the end of the second length (7*b*) of the liquid fuel passageway (7), the second section (9*b*) having a slightly decreasing cross-sectional area or diameter in the direction of the outlet (13) and the third section (9*c*) having a cross-sectional area or a diameter smaller than the cross-sectional area or diameter of the first section (9*a*). Generally, the liquid fuel passageway (7) has a cross-sectional area or a diameter greater than the cross-sectional area or the diameter of the liquid fuel port (9**).

The enclosure (5) having interior and exterior surfaces concentrically surrounds at least a portion of the length of the nozzle (3) and defines an annular passageway (15) and an annular atomizing fluid port (17) between the interior surface of the enclosure (5) and the exterior surface of the nozzle (3). The annular passageway (15) terminates with the annular atomizing fluid port (17) having inlet and outlet openings (19 and 21) for receiving and discharging liquid fuel atomizing fluid from the annular passageway (15). The annular passageway (15) normally has a cross-sectional area or a diameter greater or larger than the cross-sectional area or the diameter of the annular atomizing fluid port (17). At least a portion of the interior surface of the enclosure (5) and at least a portion of the exterior surface of the nozzle (3) defining the annular atomizing fluid port (17) are in the form of a cone having a diameter decreasing toward the outlet opening at an angle (A) in the range of about 5° to about 30°, preferably about 12° to about 18°, measured from a longitudinal axis (C) of the nozzle (3). Between the interior surface and the exterior surface, the nozzle (3) is tapered towards the liquid fuel port outlet (13), converging to an annular edge, and bringing the liquid fuel port outlet (13) and the annular atomizing fluid port outlet (21) into close proximity.

To operate the apparatus (1), liquid fuel, such as oil and coal-water mixtures, is supplied to the liquid fuel passageway (7). The liquid fuel employed generally has a viscosity in the range of about 1 to 700 Saybolt Second Universal (SSU). The supplied liquid fuel is gradually pressurized as it passes through the second length (**7*b*) of the fuel passageway (7). The pressurized liquid fuel may be further pressurized in the liquid fuel port (9) before it is ejected, thus increasing the velocity of the liquid fuel. In order to promote the formation of a liquid fuel stream having the desired narrow spray angle, the outlet (13) of the liquid fuel port (9) should terminate at the same point, i.e., the same plane, where the outlet opening (21) of the annular atomizing fluid port (17) is terminated. It is, however, possible that the outlet (13) of the liquid fuel port (9) can be located downstream of or in front of the outlet opening (21) of the annular atomizing fluid port (17) by a distance of up to about a length equal to the diameter of the outlet (13). In order to further promote the formation of a liquid fuel stream having the desired narrow spray angle, the appropriate cross-sectional area or diameter of the outlet (13) of the liquid fuel port (9) should also be provided. The cross-sectional area or diameter of the outlet (13) of the liquid fuel port (9) is dependent on the cross-sectional area or diameter of the outlet opening of the annular atomizing fluid port. The ratio of the diameter of the outlet (13) for discharging liquid fuel to the diameter of the outlet opening (21**) for ejecting atomizing fluid is in the range of about 0.25 to about 0.55, preferably about 0.35 to about 0.45. The equivalent ratio in terms of the cross-sectional area may be calculated using the following formula:

AWF (Cross-sectional area)$=\pi r^2$ where r is the radius or one half the diameter.

Generally, the diameter of the outlet (13) of the liquid fuel port (9) may be greater than 0.02 inches. The diameter of the outlet (13) is preferably in the range of about 0.02 to 1 inch, most preferably in the range of about 0.02 to 0.5 inch. The equivalent cross-sectional area is calculated using the above formula.

Atomizing fluid is delivered to the annular passageway (15) which in turn flows into the annular atomizing fluid port (17). The cross-sectional area or diameter of the annular atomizing fluid port (17) is smaller than the cross-sectional area or the diameter of the annular passageway (15), thus accelerating the velocity of the atomizing fluid as it passes through the annular atomizing fluid port (17). The pressure at which the atomizing fluid is delivered is such that the atomizing fluid is ejected at a velocity of about 0.5 Mach to about 1.2 Mach, preferably at about 0.8 to about 1.1 Mach, toward the liquid fuel stream from the outlet (13) of the liquid fuel port (9). By causing this atomizing fluid to converge the liquid fuel stream at a converging angle (A) in the range of about 5° to about 30°, preferably about 12° to about 18°, the formation of a liquid fuel spray having the desired narrow spray angle is promoted even when the liquid fuel is ejected at a low velocity, that is, 5 to 50 feet per second. The rate of the atomizing fluid delivered is such that the mass ratio of the atomizing fluid to the liquid fuel should be maintained in the range of about 0.3 to about 0.7, preferably about 0.4 to about 0.7. This ratio is also useful for forming the liquid fuel stream having the desired narrow spray angle. The desired amount of the atomizing fluid is ejected at a desired angle from the outlet opening (21) of the annular atomizing port (17) which is located at the same plane as the outlet (13) of the liquid fuel port (9) or located upstream of the outlet (13) of the liquid fuel port (9) by a distance equal to or less than the diameter of the outlet (13). The desired liquid fuel stream is in the form of a spreading spray having an outer periphery angle of less than 15°, preferably less than about 10° but greater than 2°, measured from the axis of said liquid fuel stream.

Any effective atomizing fluid may be used in the practice of this invention. Some of the known atomizing fluid include nitrogen, carbon dioxide, argon, steam, air, oxygen enriched air and pure oxygen. The atomizing apparatus (1) of the invention allows oxygen enriched air and pure oxygen to be used as an atomizing fluid without substantially increasing the risk associated with unsafe combustion. When the atomizing fluid employed is air, oxygen enriched air or pure oxygen, at least a portion of the liquid fuel is combusted outside of the apparatus (1). The combustion causes the generation of hot combustion gases which enhances the pushing and thinning of liquid fuel which in turn causes a greater degree of atomization of the liquid fuel within a furnace.

Once the liquid fuel is effectively and efficiently atomized, it can be reacted or combusted with oxidant. The oxidant may be supplied from an opening (8) annular to the annular passageway (15) or from an opening spaced away from the point at which the liquid fuel is atomized. The preferred oxidant is pure oxygen or oxygen enriched air having at least 25 percent by volume oxygen concentration.

In order to further illustrate the invention and to demonstrate the improved results obtainable thereby, the following examples are provided. They are presented for illustrative and demonstrative purposes and are not intended to be limiting.

All the tests were conducted in a cylindrical laboratory furnace having an internal diameter of about 3 feet and an internal length of about 8 feet. The furnace has at least one wall defining at least one port. The port has an internal opening facing the interior chamber of the furnace so that a burner installed therein can fire a flame into the interior chamber of the furnace. The burner is constructed by coaxially placing an atomizing apparatus, i.e., a prior art atomizer or the atomizer of the present invention, within a fluid conduit having stainless steel and/or ceramic tip. The burner provides an inner fuel passageway, an atomizing fluid passageway and an annular oxidant passageway. This burner was placed within the port. If the burner was to be used without water cooling, the tip of the burner is recessed at least twice the diameter of an outlet of the fuel passageway from the internal opening of the refractory port. For the purposes of this experiment, the tip of the burner has been recessed about ⅛ inches from the internal opening of the port. The burner was designed to fire at a firing rate of 1 MM BTU/hr into the interior chamber of the furnace. Nitrogen was injected into the furnace from three different point of the furnace in order to simulate air infiltration which is known to exist in industrial furnaces. The furnace refratory wall average temperature was kept at 2800 oF during NOx (nitrogen oxides) measurement. The NOx results are expressed in terms of NO (nitrogen oxide) measured by a chemiluminescent analyzer catalytic cell and expressed as pound per NO2 per MM Btu of the fuel fired. The abbreviated term "MM" means million.

Initially, a test was carried out after constructing a burner with the atomizer disclosed in U.S. Pat. No. 4,738,614 as indicated above. To this burner, oil fuel having a nitrogen content of 0.22% by weight, a density of 0.0898 at 140° F. and a gross heating value of 18503 BTU/lb was delivered. The temperature at the inlet of the burner was kept at 180° F. in order to keep the oil viscosity at about 16 Centistok (CST) or 80 SSU. The oil delivered was atomized with steam for combustion. During the atomization of oil, there was a strong interference of the steam pressure on the oil flow rate. The interference made the control of the flow rates of both steam and oil difficult. The oil pressure at the inlet of the burner had to be increased to about 70 psig in order to minimize the interference. In the meantime, the atomizer incorporated into the burner produced an atomized oil having a wide spray angle and caused soot deposit at the tip of the burner.

The test was repeated under the identical condition after constructing a burner with the atomizer of the present invention as indicated above. The atomizer of the present invention imparted an atomized oil having a constant narrow spray angle at all flow rates. This allowed the burner to be operated without water cooling and without causing much soot deposit at the tip of the burner. Also, there was no interference of the steam pressure on the oil flow rate, thus allowing the burner operate at lower oil back pressure. In addition, the fuel oil did not flow into the atomizing fluid passageway, thus enabling the burner to operate using an oxygen containing gas as an atomizing fluid.

When the test was again repeated after varying atomizing steam/oil ratios and varying angles at which an annular atomizing fluid converges the fuel oil, it was found that a higher atomizing stem/oil ratio reduced the nitrogen oxides emission level and a converging angle of 15° or approximately 15° produced a fuel oil stream having the narrowest spray angle, measured from the axis of the fuel oil stream.

Although the atomizing methods and apparatus of the present invention have been described in detail with reference to certain embodiments, those skilled in the art will recognize that there are other embodiments of the invention within the spirit and scope of the appended claims.

What is claimed is:

1. An apparatus for atomizing liquid fuel for effective combustion with reduced nitrogen oxides generation, said apparatus comprising:

(a) a nozzle having interior and exterior surfaces, with said interior surface defining a liquid fuel passageway and a liquid fuel port, said liquid fuel port having an inlet for receiving liquid fuel from said liquid fuel passageway and an outlet for discharging liquid fuel; and (b) an enclosure having interior and exterior surfaces concentrically surrounding at least a portion of said nozzle and defining an annular passageway and an annular atomizing fluid port between said interior surface of said enclosure and said exterior surface of said nozzle, with said annular passageway terminating with said annular atomizing fluid port having inlet and outlet openings, wherein both at least a portion of the interior surface of said enclosure and at least a portion of said exterior surface of said nozzle defining said annular atomizing fluid port are in the form of a cone having a diameter decreasing toward said outlet opening of said annular atomizing fluid port, at an angle in the range of about 5° to about 30°, measured from a longitudinal axis of said nozzle and wherein the nozzle, between the interior and exterior surfaces, converges to a sharpened annular edge at the outlet of the fuel port.

2. The apparatus according to claim 1, wherein the ratio of the outlet diameter of said liquid fuel port to the outlet diameter of said annular atomizing fluid port is in the range of about 0.35 to about 0.45.

3. The apparatus according to claim 1, wherein both said at least a portion of the interior surface of said enclosure and said at least a portion of said exterior surface of said nozzle defining said annular atomizing fluid port are in the form of a cone having a diameter decreasing toward said outlet opening of said annular atomizing fluid port, at an angle in the range of about 12° to about 18°, measured from a longitudinal axis of said nozzle.

4. The apparatus according to claim 1, wherein the outlet of said liquid fuel port is located at the same plane as the outlet opening of the annular atomizing fluid port.

5. The apparatus according to claim 1, wherein said apparatus for atomizing liquid fuel is located in a position recessed in a furnace wall.

6. The apparatus according to claim 1, further comprising an additional enclosure having interior and exterior surfaces concentrically surrounding at least a portion of said enclosure and defining an annular passageway between said interior surface of said additional enclosure and said exterior surface of said enclosure for supplying additional atomizing fluid.

7. The apparatus according to claim 1, wherein the liquid fuel passageway of said nozzle is comprised of at least two lengths and wherein a first length has a large cross sectional area, and a second length, which communicates with the first length, has a cross sectional area which decreases in the direction of the liquid fuel port of the nozzle.

8. The apparatus according to claim 7, wherein the liquid fuel port of said nozzle is comprised of at least three sections and wherein a first section having a cross-sectional area equal to or smaller than the cross sectional area at the end of the second length of the liquid fuel passageway communicates with a second section having a cross-sectional area decreasing in the direction of the outlet, and said second section communicates with a third section having a cross-sectional area smaller than that of the first section.

9. The apparatus according to claim 1, wherein said apparatus for atomizing liquid fuel provides a liquid fuel stream in the form of a spreading spray having an outer periphery angle of less than 15°.

10. The apparatus according to claim 1, wherein said apparatus for atomizing liquid fuel provides a liquid fuel stream in the form of a spreading spray having an outer periphery angle of about 2° to about 10°.

11. The apparatus according to claim 1, wherein the ratio of the outlet diameter of said liquid fuel port to the outlet opening diameter of said annular atomizing fluid port is in the range of about 0.25 to about 0.55.

12. A process for atomizing liquid fuel to provide a liquid fuel stream in the form of a spreading spray having an outer periphery angle of less than 15°, measured from the axis of said liquid fuel stream, thus promoting effective combustion with reduced nitrogen oxide generation, said process comprising:

(a) ejecting a liquid fuel stream from at least one first opening of a nozzle;

(b) ejecting atomizing fluid from at least one second opening annular to said at least one first opening at a velocity of about 0.5 Mach to about 1.2 Mach toward said liquid fuel stream at a converging angle in the range of about 5° to about 30°, measured from a longitudinal axis of said nozzle, and wherein said nozzle converges to an annular edge between said at least one first opening and said at least one second annular opening.

13. The process according to claim 12, wherein said liquid fuel is ejected at less than 50 feet per second.

14. The process according to claim 12, wherein said atomizing fluid is ejected at a velocity of at about 0.8 to about 1.1 Mach toward said liquid fuel stream at a converging angle in the range of about 12° to about 18°, measured from a longitudinal axis of said nozzle.

15. The process according to claim 12, wherein the rate of said atomizing fluid injected is such that the mass ratio of said atomizing fluid to said liquid fuel is maintained in the range of about 0.4 to about 0.7.

16. The process according to claim 12, wherein said atomizing fluid is selected from the group consisting of steam, nitrogen, air, oxygen-enriched air and pure oxygen.

17. The process according to claim 12, wherein said at least one first opening has a diameter in the range of about 0.02 inch to about 1 inch.

* * * * *